US007533774B2

(12) United States Patent
Zimmerman

(10) Patent No.: US 7,533,774 B2
(45) Date of Patent: May 19, 2009

(54) COMBINED CONTAINER, ACTIVITY TRAY AND MAILER

(76) Inventor: Beth Zimmerman, 2424 SW. Wintergreen Ct., Lee's Summit, MO (US) 64081

( * ) Notice: Subject to any disclaimer, the term of this patent is extended or adjusted under 35 U.S.C. 154(b) by 326 days.

(21) Appl. No.: 11/355,456

(22) Filed: Feb. 16, 2006

(65) Prior Publication Data

US 2007/0187290 A1 Aug. 16, 2007

(51) Int. Cl.
*B65D 75/00* (2006.01)
*B65D 85/575* (2006.01)
*B65D 5/50* (2006.01)

(52) U.S. Cl. ..... 206/784; 206/387.14; 206/765

(58) Field of Classification Search ..... 206/784, 206/476, 307, 387.1, 387.14, 565, 564, 558, 206/562, 495, 557, 232, 764, 765, 759, 762; 229/906, 151, 178
See application file for complete search history.

(56) References Cited

U.S. PATENT DOCUMENTS 1,581,800 A * 4/1926 Hellweg ..... 229/117.24
1,783,453 A 12/1930 Reisert
2,117,502 A 5/1938 Reich
2,168,387 A 8/1939 Bellin
2,249,657 A 7/1941 Junkin
2,305,087 A * 12/1942 Keller ..... 229/120.13
2,645,407 A 7/1953 Bergstein
2,758,774 A 8/1956 Grunert et al.
2,795,368 A 6/1957 Caster et al.
2,981,458 A 4/1961 Thibault
3,269,637 A 8/1966 Whittaker
3,355,086 A 11/1967 Ingle
3,625,410 A 12/1971 Hirschey
3,724,650 A 4/1973 Forbes, Jr.
3,899,119 A 8/1975 Roccaforte
4,090,608 A 5/1978 McCall
4,530,459 A 7/1985 Maroszek
4,637,544 A 1/1987 Quercetti
4,739,921 A 4/1988 Taub
4,757,937 A 7/1988 Maio et al.
5,144,914 A 9/1992 Giannakopoulos
5,775,489 A * 7/1998 Vickers ..... 206/307.1
5,788,081 A 8/1998 Bates
5,794,631 A 8/1998 Sylvester
5,823,352 A * 10/1998 Mena et al. ..... 206/721
5,934,551 A 8/1999 Kaufman
5,938,109 A * 8/1999 Sainz et al. ..... 229/120.21
5,950,912 A * 9/1999 Economopoulos ..... 229/120.32
5,984,755 A 11/1999 Avey
6,112,978 A * 9/2000 Barr et al. ..... 229/120.21

(Continued)

*Primary Examiner*—Bryon P Gehman
*Assistant Examiner*—Ernesto A Grano
(74) *Attorney, Agent, or Firm*—Hovey Williams LLP

(57) ABSTRACT

An improved, multiple use container (20) is provided having a primary container (22), a shelf insert (24) and a tray inset (26). The preferred container (20) provides a storage area (229) sized to receive a video cassette (232) book, or other appropriately sized item, with the insert (26) adapted to hold associated items such as toys, food or the like. The container (20) has a closure assembly (38) which can be alternately oriented in a fully closed condition so that the container (20) may be used for storage, carrying or mailing purposes, or an open and secured orientation allowing access to the contents of the container without any interferences from the closure assembly (38).

13 Claims, 9 Drawing Sheets

U.S. PATENT DOCUMENTS 6,213,389 B1 * 4/2001 Cai ..... 229/120.08
6,527,123 B1 3/2003 Ausaf
6,948,616 B2 9/2005 Gillani
6,971,524 B1 * 12/2005 Voswinkel ..... 206/762
6,981,589 B2 * 1/2006 Sanders, Jr. ..... 206/320
7,264,123 B2 * 9/2007 Reed ..... 206/765
2003/0015579 A1 1/2003 LeBras et al.
2004/0200891 A1 10/2004 Correll
2005/0247597 A1 * 11/2005 Reed ..... 206/775

* cited by examiner

COMBINED CONTAINER, ACTIVITY TRAY AND MAILER

BACKGROUND OF THE INVENTION

1. Field of the Invention

The present invention is broadly concerned with a storage container which can be alternately configured for storage, carrying and mailing purposes, and also to provide convenient access to materials within the container, and selective configuration as a tray or activity surface. More particularly, the invention is concerned with such a multiple function container, and blanks used in fabricating the container, wherein the container is especially adapted to hold a video cassette or book, as well as other activity items.

2. Description of the Prior Art

Containers of various types and configuration have been produced in myriad styles and forms. These range from simple paperboard boxes to more complicated designs having specialized internal compartments. See, e.g., U.S. Pat. Nos. 3,899,119, 2,249,657 and 2,758,774. Other references describing boxes and containers of different designs include: U.S. Pat. Nos. 4,739,921, 1,783,453, 2,168,387, 2,117,502, 2,645,407, 2,795,368, 3,269,637, 2,981,458, 3,355,086, 3,625,410, 4,530,459, 4,637,544, 4,757,937, 5,144,914, 5,984,755, 6,527,123, 6,948,616, 2003/0015579, 2004/0200891, 3,724,650, 4,090,608, 5,788,081, 5,934,551, 5,794,631.

Many children like to watch prerecorded videos on video tapes or the like. Such child-oriented tapes may also come with associated activity items. For example, a video tape directed to prehistoric dinosaurs may come with associated dinosaur toys. However, the toys are often lost because there is no convenient way to store them along with the video tape. Further, storage of such items subsequent to mailing is often difficult. Similarly, food items, prepared or packaged, are often stored and carried in suitable containers, but such containers can be cumbersome when accessing and consuming the food items therefrom.

SUMMARY OF THE INVENTION

The present invention overcomes the problems outlined above and provides an improved container which can be used for storage, carrying and mailing, and can be alternately configured to allow ready access to the contents thereof, as well as to provide a convenient tray or activity surface. In preferred forms, the container of the invention is designed to store a video tape, book, prepackaged food or other like items, along with associated items such as toys or the like.

Broadly speaking, the container of the invention includes a primary container having a bottom wall panel and opposed sidewall panels and a front panel, and a shelf within the primary container so as to define a storage space between the shelf and bottom wall having a rearwardly facing access opening. Preferably, a tray insert is also provided which sits atop the shelf and provides space for other items. The container also has a closure assembly operatively secured to the rear margin of the bottom wall panel and configured to cover the rearward access opening of the storage space and also the open top of the primary container. The closure assembly in one configuration is used to completely close the container for storage, carrying and/or mailing. In another orientation, the closure assembly is reconfigured by folding so as to open the storage area and allow access to and easy use of the storage area and the upper shelf or tray area, and can be selectively secured in such open configuration so as to effectively convert the container to a tray or activity surface.

In another aspect of the invention, blanks are provided for the fabrication of the components making up the preferred container. These include a primary container blank, a shelf insert blank and a tray insert blank. The blanks are appropriately folded and cooperatively form the desired container or activity surface.

DETAILED DESCRIPTION OF THE PREFERRED EMBODIMENT

Figure 13:
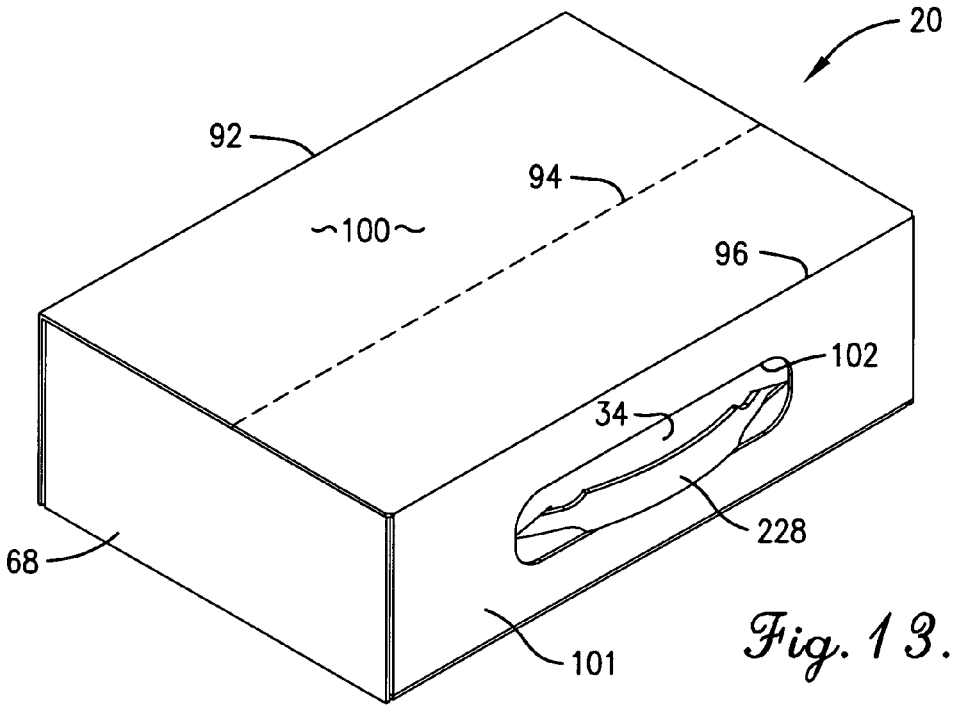
FIG. 13 is a perspective view of the completed container of the invention.
Figure 15:
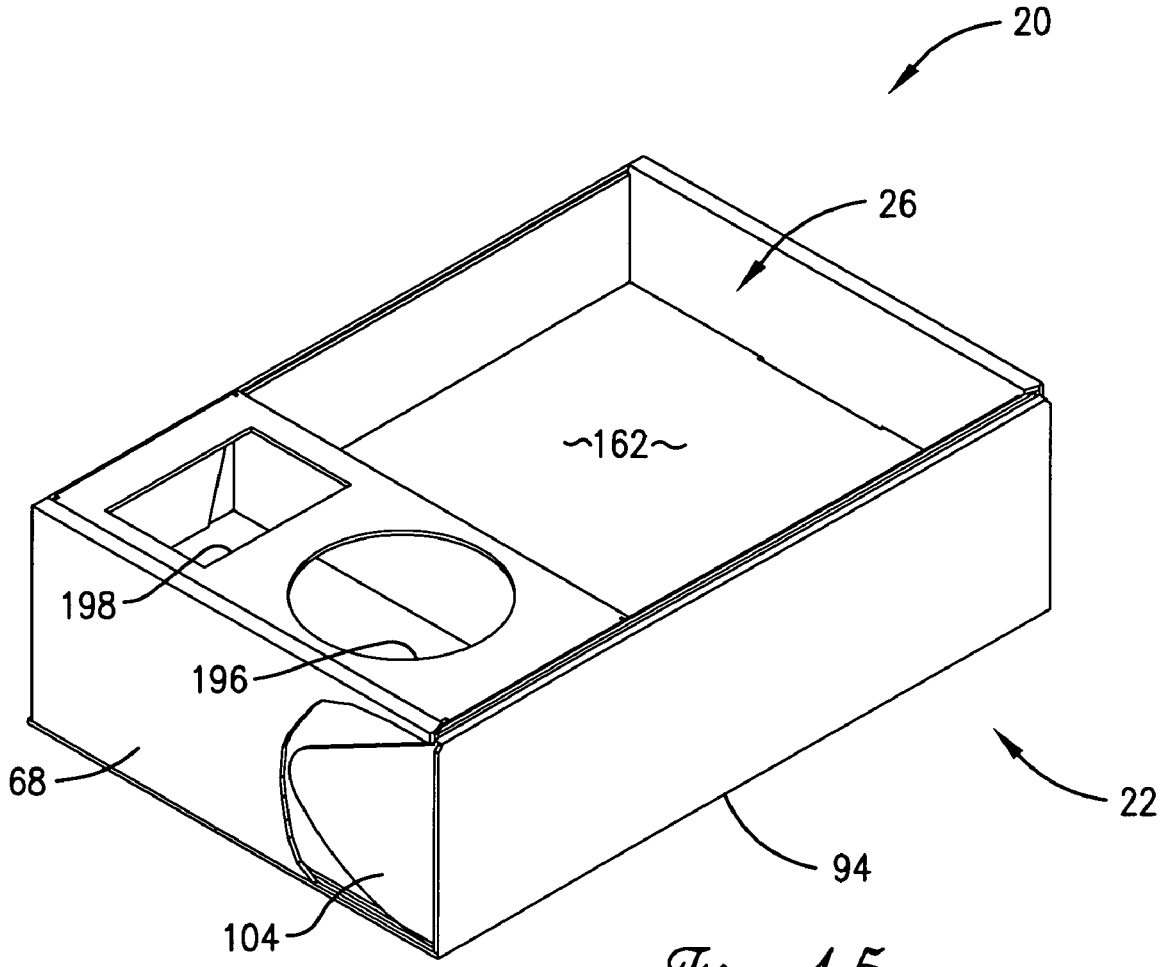
FIG. 15 is a perspective view with parts broken away and similar to that of FIG. 14, but showing the final alternate configuration of the container.

Turning now to the drawings, a multiple use or function container 20 is illustrated which can assume a closed, carrying position as seen in FIG. 13, or alternately an open use position depicted in FIG. 15. Broadly speaking, the container 20 is made up of a primary box-like container 22, a shelf insert 24 within the container 22, and an optional tray insert 26 likewise positioned within primary container 22 atop insert 24. The primary container 22 is fabricated from primary container blank 28, while shelf insert 24 is fabricated from shelf insert blank 30, and tray insert 26 is fabricated from tray insert blank 32.

Figure 1:
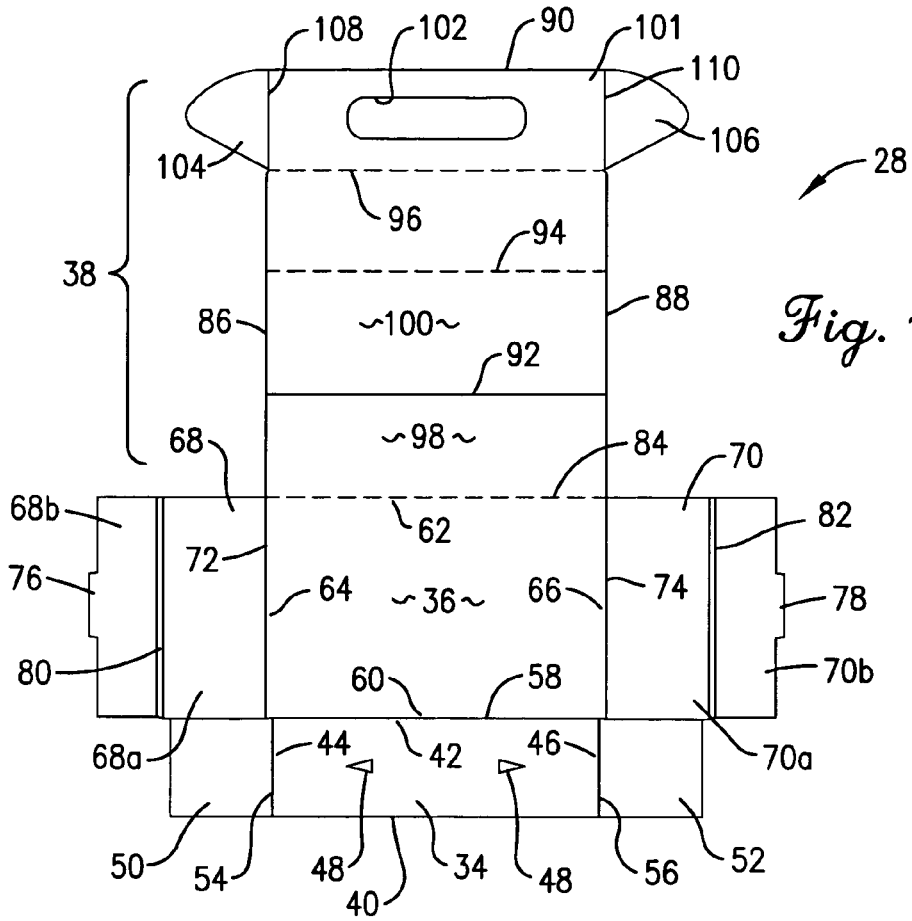
FIG. 1 is a plan view of the primary container blank of the invention.
Figure 2:
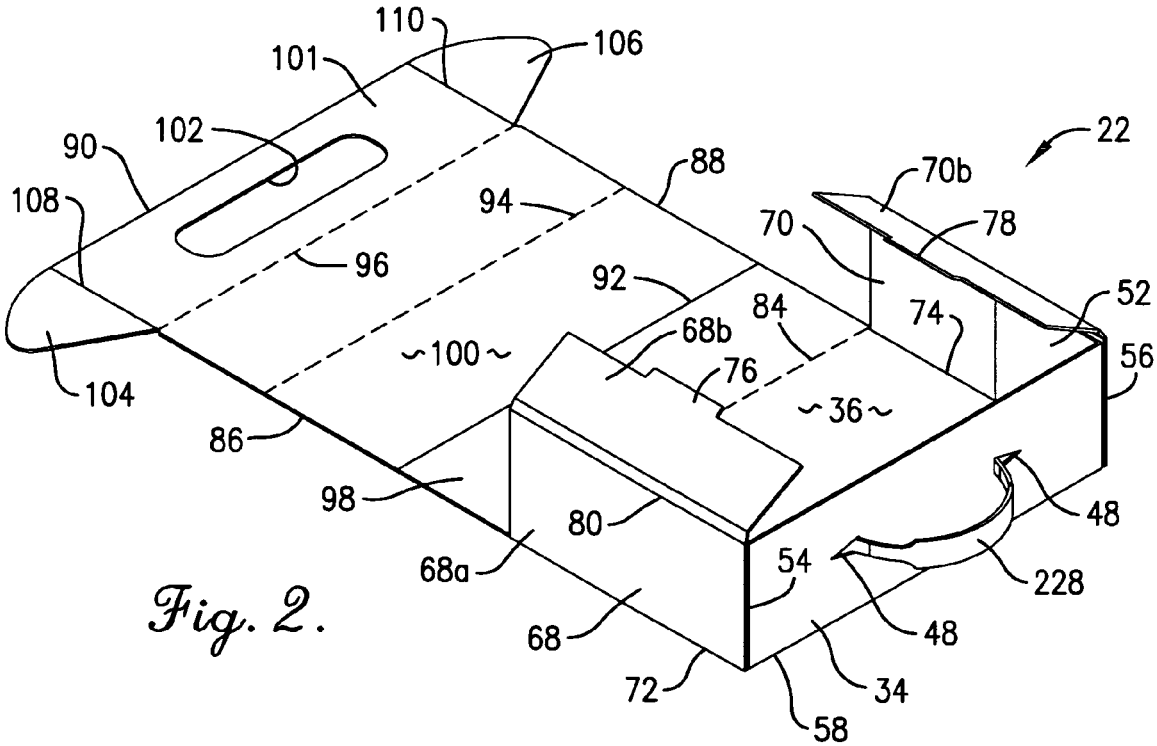
FIG. 2 is a perspective view of a partially constructed primary container formed from the blank of FIG. 1.

In more detail, turning initially to FIGS. 1 and 2, the primary container blank 28 is in the form of an integral sheet of paperboard or the like, presenting a front panel 34, bottom panel 36 and closure assembly 38. The front panel 34 is rectangular and presents front and rear margins 40, 42, and opposed side margins 44 and 46. When including an optional handle feature, the front panel 34 has a pair of spaced handle-receiving apertures 48 formed therein. A pair of first flaps 50, 52 are respectively secured to the side margins 44, 46 of front panel 34, along fold lines 54, 56.

The bottom panel 36 is likewise rectangular in configuration and is secured to front panel 34 along lateral fold line 58. The bottom panel 36 has a front margin 60, rear margin 62 and side margins 64, 66. A pair of second flaps 68, 70 are secured to and extend from each of the side margins 64, 66, along respective fold lines 72, 74. Each of the flaps 68, 70 has an outermost connection tab 76, 78, the purpose of which is to be described below. In addition, each of the flaps 68, 70 has an intermediate fold line 80, 82, which divides the flaps into respective sections 68*a*, 68*b* and 70*a*, 70*b*. It will be observed that the fold lines 80, 82 are located such that the distance between the fold lines 80, 82 and the corresponding adjacent fold lines 72, 74 is greater than the distance between the fold lines 80, 82 and the corresponding outer free edges of the flaps 68 and 70.

The closure assembly 38 is secured to the rear margin 62 of bottom panel 36 along fold line 84. The assembly 38 also presents side margins 86, 88, as well as outboard, transverse margin 90. The assembly 38 has first, second and third mutually parallel and spaced apart intermediate fold lines 92, 94 and 96, thereby defining a rear panel 98 between fold line 84 and first intermediate fold line 92; a top panel 100 between first and third intermediate fold lines 92, 96; and a connection panel 101 between third intermediate fold line 96 and outboard margin 90.

It will be observed that the distance between fold lines 84 and 94 is substantially equal to the distance between fold lines 58 and 84. The first intermediate fold line 92 is also oriented such that the distance between it and third intermediate fold line 96 is also substantially equal to the distance between fold lines 58 and 84. In addition, the distance between fold line 84 and fold line 92 is substantially equal to the distance between front and rear margins 40 and 42 of front panel 34.

The connection panel 101 optionally includes a central handle-clearing slot opening 102, and also includes laterally extending third connection flaps 104, 106 secured along respective fold lines 108, 110.

Figure 3:
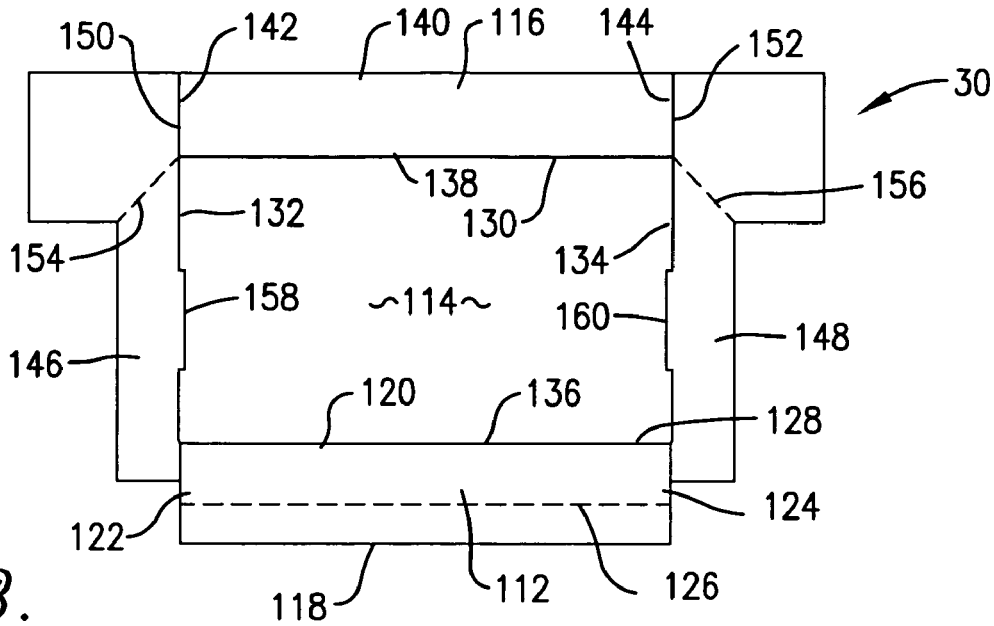
FIG. 3 is a plan view of a shelf insert blank.
Figure 4:
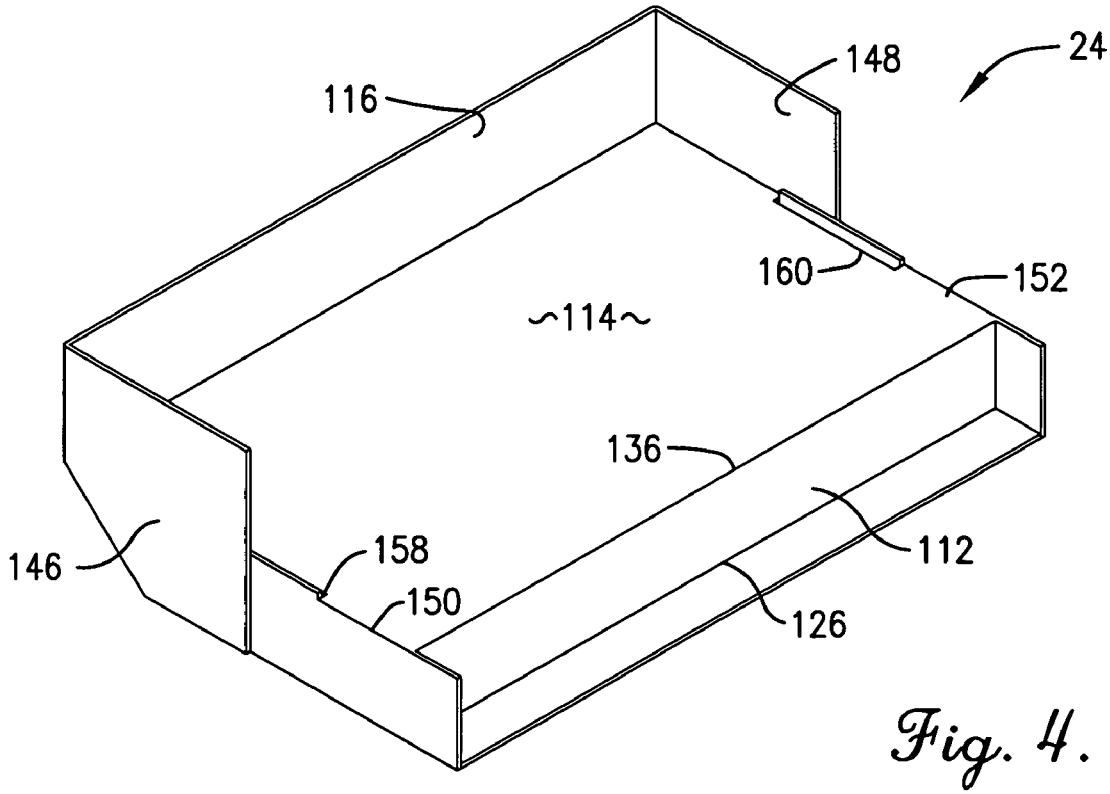
FIG. 4 is a perspective view illustrating the shelf insert formed from the blank of FIG. 3.

Turning next to FIGS. 3 and 4, the shelf insert blank 30 is integrally formed from paperboard or the like, and has a front step panel 112, top panel 114 and sidewall panel 116. Step panel 112 is generally rectangular, presenting a forward margin 118, rear margin 120 and side margins 122, 124. As illustrated, the step panel 112 also has an intermediate, laterally extending fold line 126 extending between side margins 122, 124 and parallel with the front and rear margins 118, 120.

The top panel 114 is generally rectangular, having front margin 128, rear margin 130 and side margins 132, 134. The top panel 114 is connected to step panel 112 via fold line 136. The sidewall panel 116 is generally rectangular, having front margin 138, rear margin 140 and side margins 142, 144. The sidewall panel 116 is connected to top panel 114 via fold line 137.

The blank 30 also includes sidewall flaps 146 and 148 which are secured to sidewall panel 116 and top panel 114 along fold lines 150, 152. The flaps 146, 148 also extend beyond the fold line 136, but are not connected with step panel 112. As shown, each of the flaps 146, 148 is somewhat of inverted L-shape, and has a diagonal fold line 154, 156 extending from the adjacent end of fold line 130 to the juncture of the "L." Finally, it should be noted that a pair of connection slots 158, 160 are provided along the fold lines 150, 152, at the central region of top panel 114.

Figure 5:
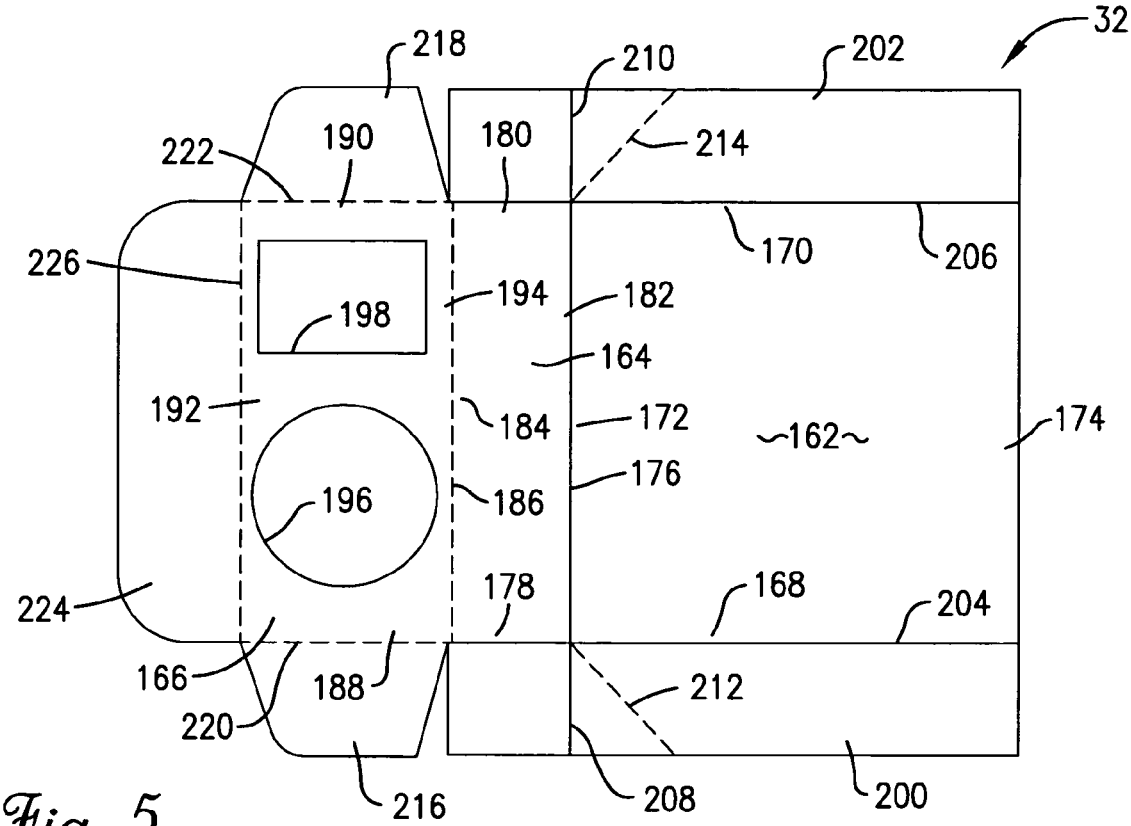
FIG. 5 is a plan view of a tray insert blank.
Figure 6:
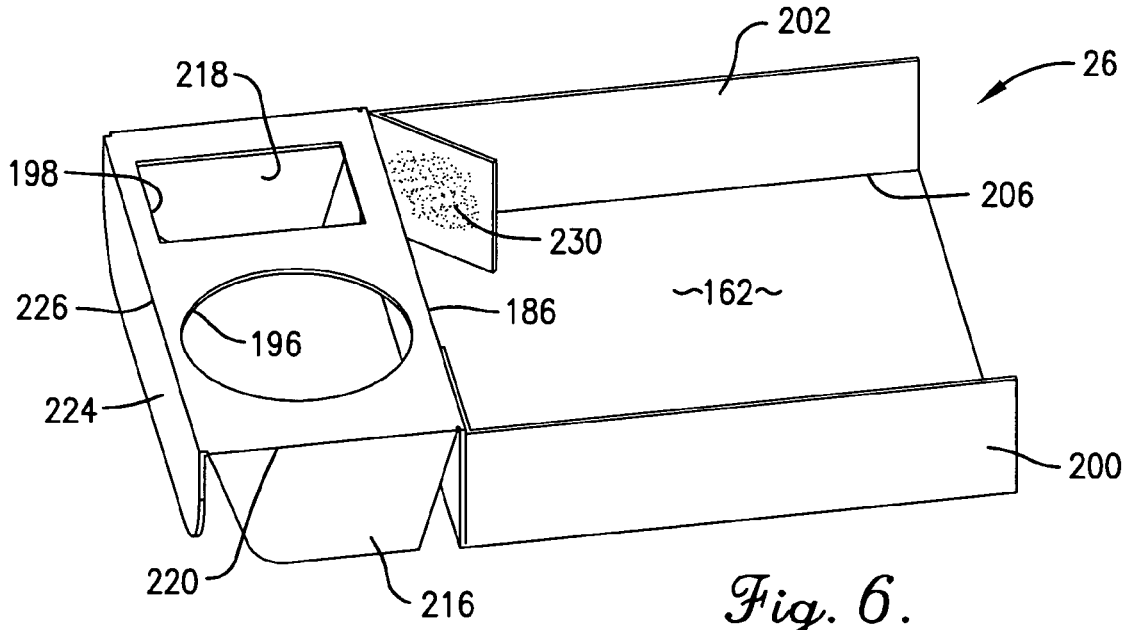
FIG. 6 is a perspective view of the tray insert formed from the blank of FIG. 5.

Turning next to FIGS. 5 and 6, the tray insert blank 32 is integrally formed of paper board or the like, including food safe cardboard, and has a bottom wall panel 162, a sidewall 164 and an apertured top panel 166. The bottom panel 162 has front and rear margins 168, 170, and side margins 172, 174. Panel 164 is secured to the panel 162 along fold line 176 and has front and rear margins 178, 180 and side margins 182, 184. The apertured top panel 166 is secured to panel 164 along fold line 186, and has front and rear margins 188, 190, and side margins 192, 194. As shown, the panel 166 has a circular opening 196 as well as a rectangular opening 198.

The panels 162 and 164 each have a rectangular flap 200, 202 secured thereto along individual fold lines 204, 206. Each of the flaps 200, 202 has a lateral fold line 208, 210 extending from fold line 176 to the outer margin of the respective flap. In addition, each of the flaps 200, 202 has a diagonal fold line 212, 214 extending from the fold line 176 as shown.

The top panel 166 also includes a pair of flaps 216, 218 secured along respective fold lines 220, 222. Finally, the panel 166 also has a side flap 224 secured thereto along fold line 226.

The container 20 is fabricated from the blanks 28, 30 and 32. Generally, this construction proceeds by first fabricating the shelf insert 24, using blank 30. This involves folding the step panel 112 about fold lines 126 and 136 (FIG. 4), and then folding the sidewall flaps 146, 148 about fold lines 150, 152 and 154, 156, and sidewall panel 116 about fold line 137. This opens the slots 158, 160 and creates the shelf insert 24 which is inserted within the primary container 22 as will be described.

In the next step (FIG. 2), the primary container 22 is partially fabricated. If an optional handle is desired, this step involves first installing a flexible, synthetic resin handle 228 within the apertures 48. Next, front panel 34 is folded upwardly along fold line 58, with the first flaps 50, 52 folded inwardly along fold lines 54, 56. Next, the second flaps 68 and 70 are folded upwardly along fold lines 72 and 74, and flap sections 68*b* and 70*b* are folded upwardly along fold lines 80 and 82, until the blank assumes the FIG. 2 configuration.

Figure 7:
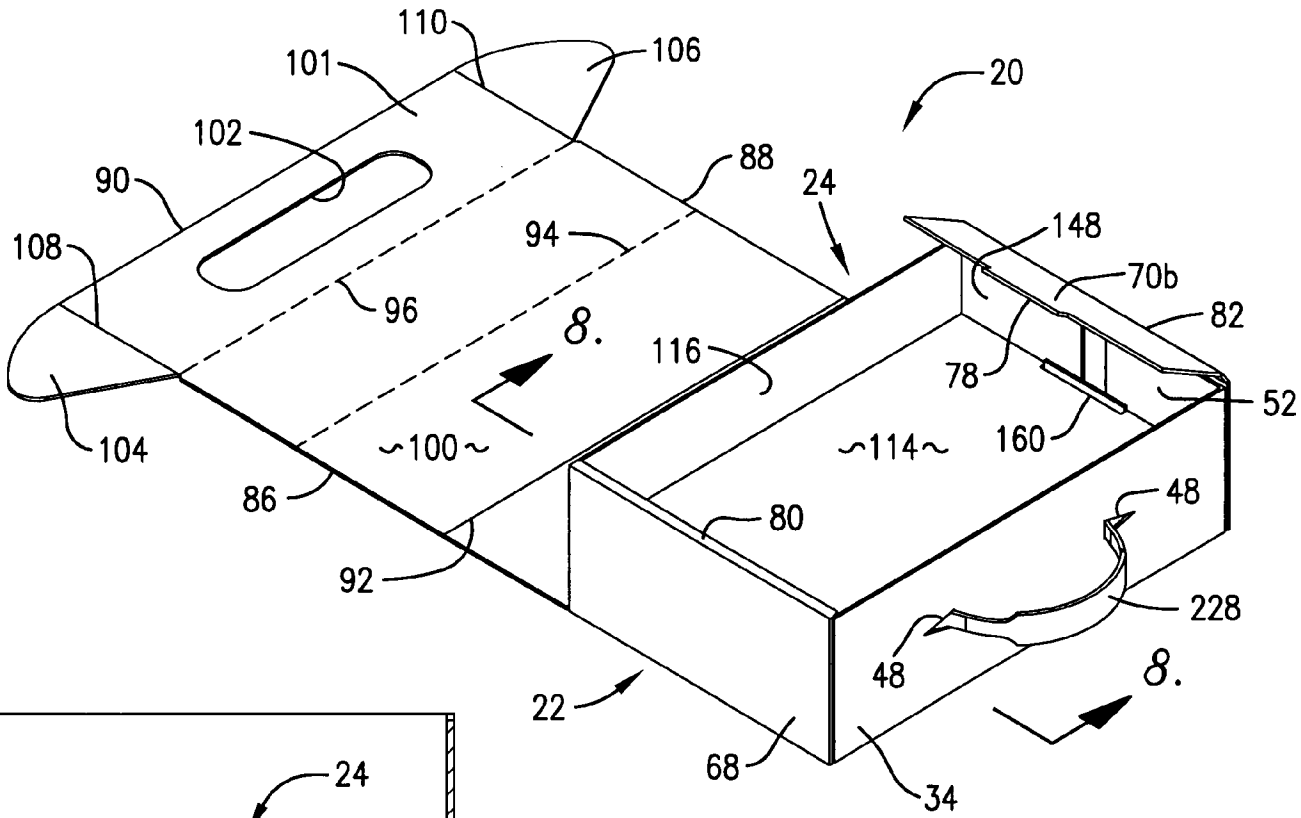
FIG. 7 is a perspective view illustrating the primary container, together with the shelf insert partially installed in the primary container.
Figure 8:
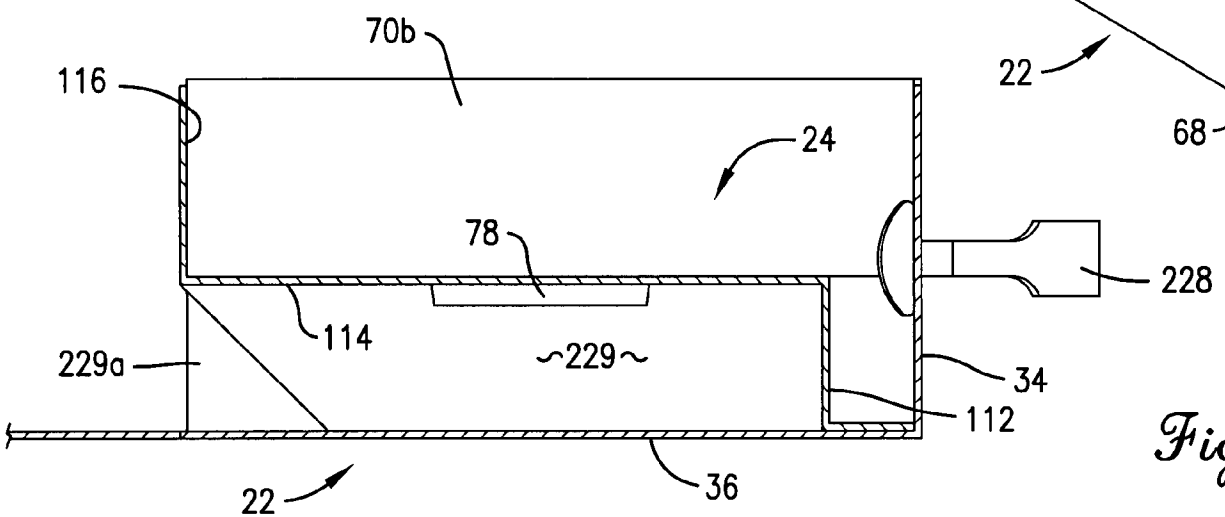
FIG. 8 is a sectional view taken along line 8-8 of FIG. 7.

At this point (FIGS. 7 and 8), the insert 24 is positioned over bottom panel 36 with the front margin 118 abutting the inner surface of front panel 34 and with the sidewall flaps 146, 148 essentially in face-to-face contact with the inner surfaces of the second flap sections 68*a*, 70*a*. The second flap sections 68*b* and 70*b* are then folded along fold lines 80, 82 over the upper edges of first flaps 50, 52, and the sidewall flaps 146, 148. Thereupon, the tabs 76, 78 are inserted into the slots 158, 160. This serves to lock the shelf insert 24 in place within the confines of primary container 22.

In this condition, it will be seen that the container 22 has a lower storage compartment 229 between top panel 114, bottom panel 36, second flaps 68, 70 and step panel 112. The compartment 229 also has a rearwardly facing access opening 229*a*.

Figure 9:
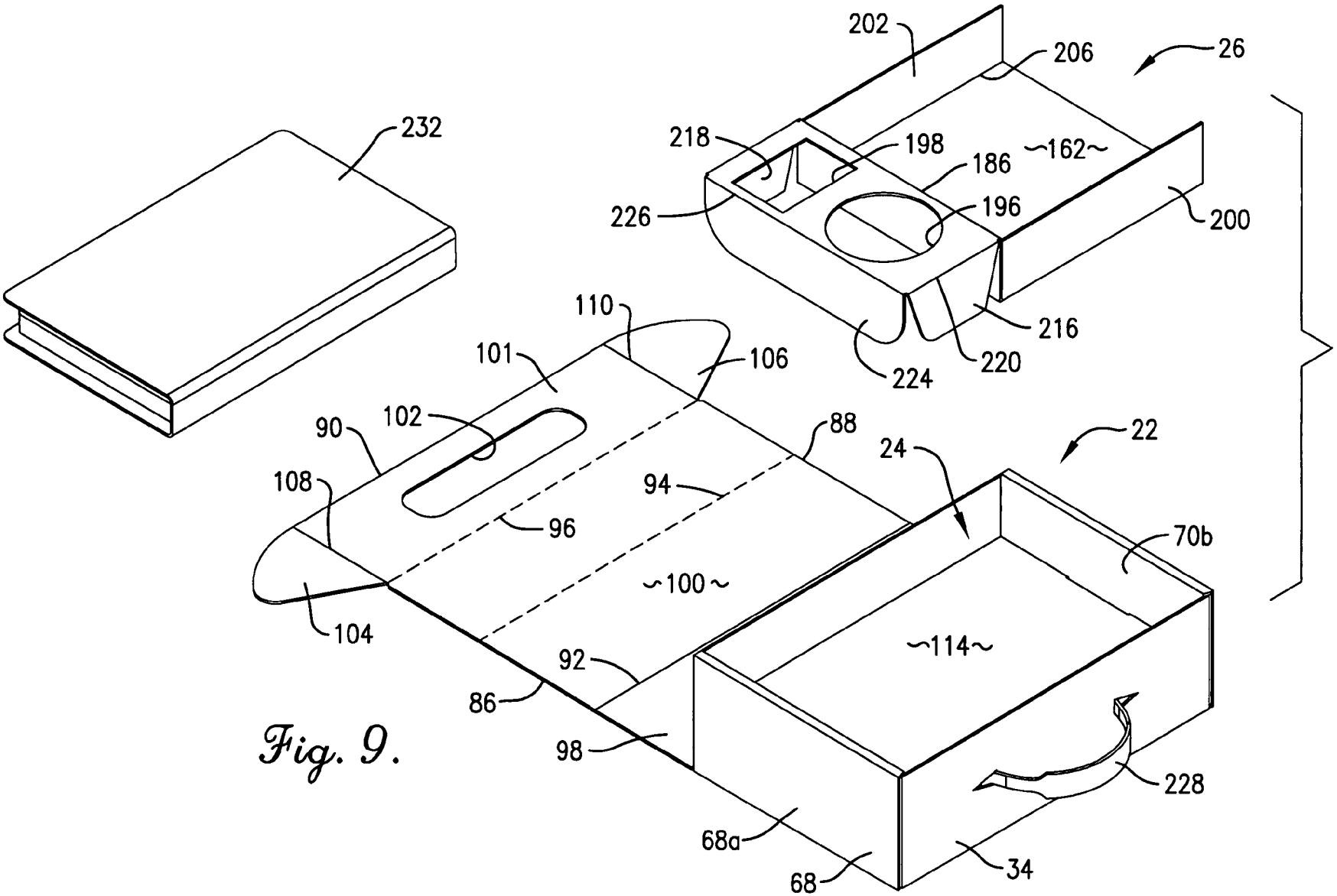
FIG. 9 is an exploded perspective view illustrating the formed primary container and shelf insert, together with the tray insert, and also showing a video tape package for insertion into the primary container.
Figure 10:
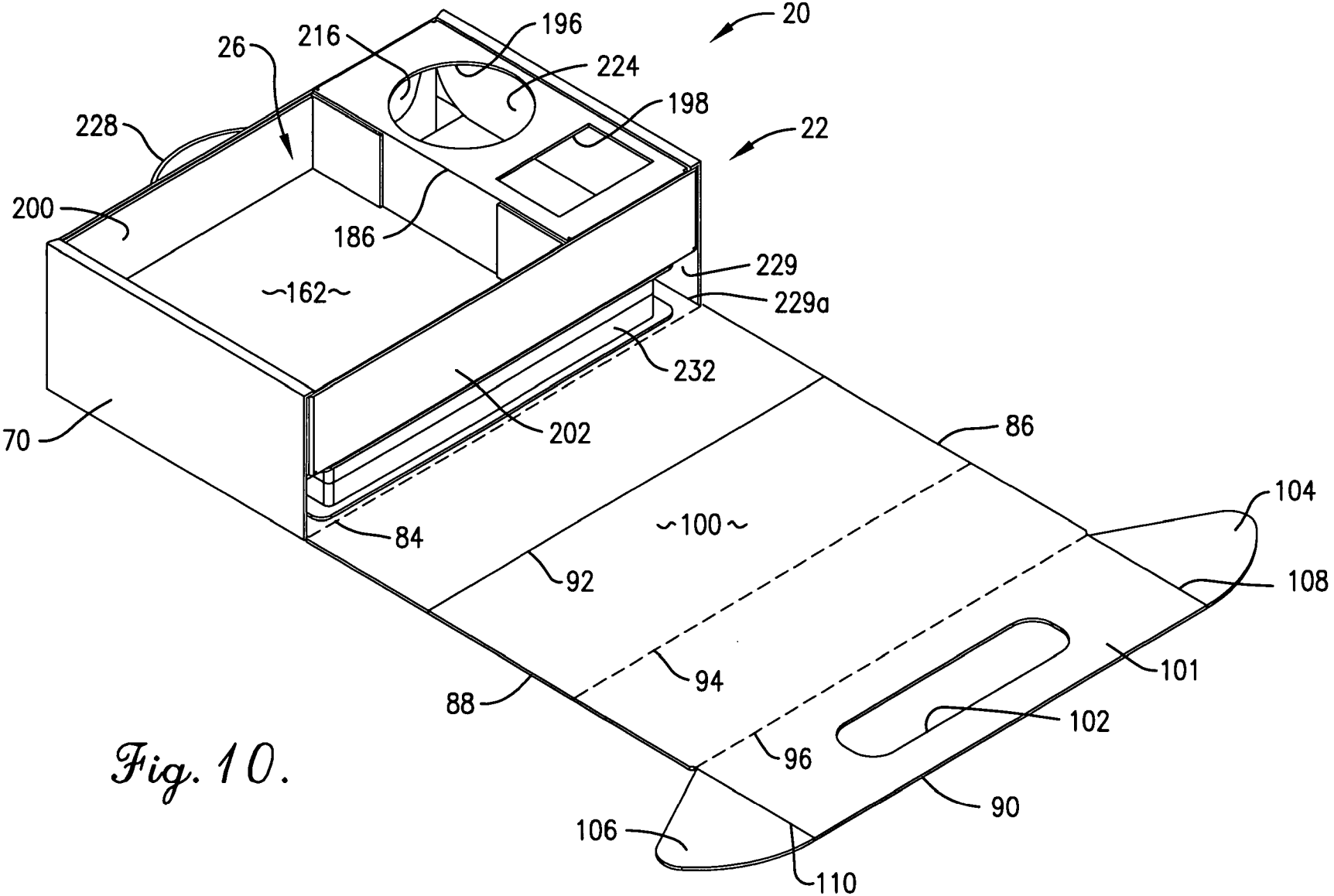
FIG. 10 is a perspective view opposite to that FIG. 9, and showing the video cartridge and tray within the primary container.

As seen in FIGS. 5 and 6, the tray insert 26 is constructed by folding panel 164 upwardly about fold line 176 and also folding the flaps 200, 202 upwardly about fold lines 204, 206. Also, the ends of the flaps 200, 202 are folded inwardly along lines 208, 210, thereby allowing the flap ends to be secured via adhesive 230 to the adjacent face of panel 164. In order to complete the insert, the flaps 216, 218 and 224 are folded downwardly about lines 220, 222 and 226. Upon completion, the insert 26 is placed within primary container 22, atop panel 114. This construction is illustrated in FIGS. 9 and 10, for example.

The container 20 is next loaded with a video cassette 232, book, prepackaged food item or other appropriately sized item as well as associated activity materials (not shown). In particular, the cassette 232 is inserted into space 229 through opening 229*a*, and the other associated activity materials are placed on bottom panel 162 and within the openings 196 and 198 as required.

Figure 11:
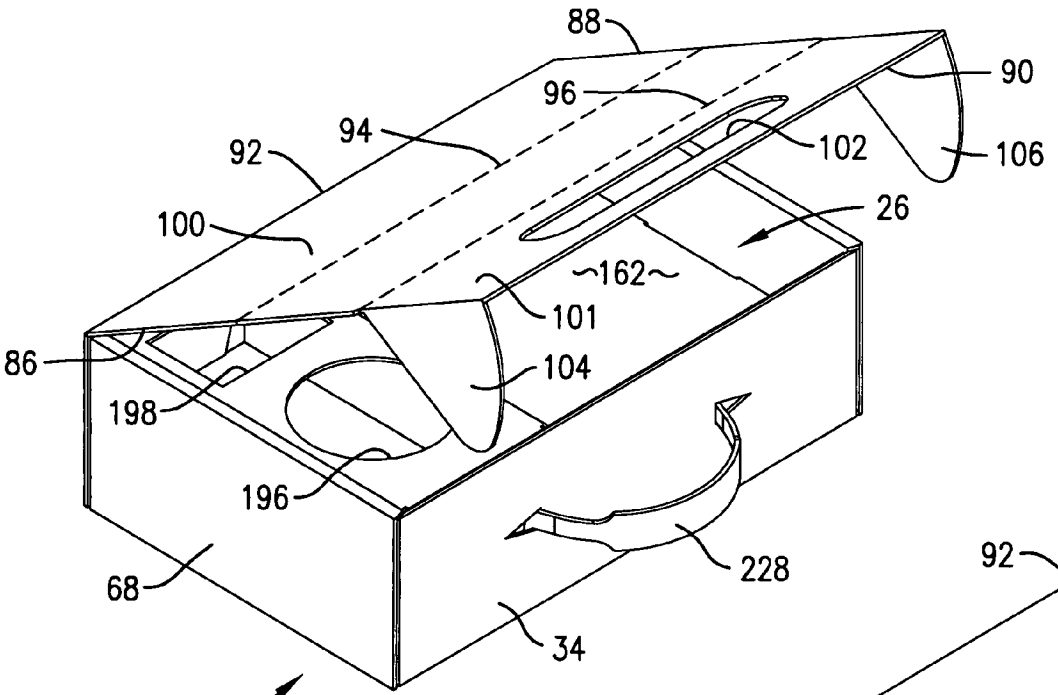
FIG. 11 is a perspective view similar to that of FIG. 10, but depicting the next step in fabrication of the complete container through use of the closure assembly forming a part of the primary container.
Figure 12:
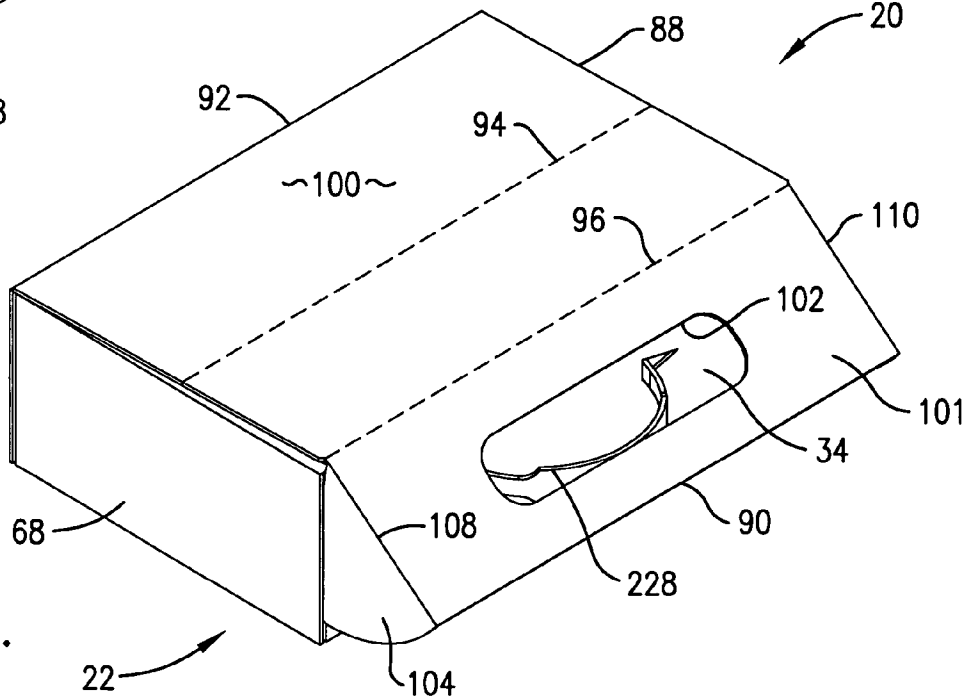
FIG. 12 is a perspective view similar to that of FIG. 11, but illustrating the final construction step to complete the container.

Once loaded, the closure assembly 38 is used to close the container 20, as illustrated in FIGS. 11 and 12, until it assumes the storage, carrying, or mailing position depicted in FIG. 13. Specifically, the closure assembly 38 is grasped and folded about fold line 84 so that rear panel 98 comes into facing and covering relationship with upstanding flap 202 (or shelf sidewall panel 116 if tray insert 26 is not utilized in a particular configuration) and compartment access 229*a*. The assembly is then further folded about line 92 so that the top panel 100 is moved into full covering relationship with the open top of container 22. Finally, the connection panel 101 is folded downwardly about line 96 and the flaps 104, 106 are folded about lines 108, 110. These flaps 104, 106 are inserted between the side margins 44, 46 of front panel 34, and the adjacent segments 68*a* and 70*a* of second flaps 68 and 70. Handle 228 is then passed through slot 102.

Figure 14:
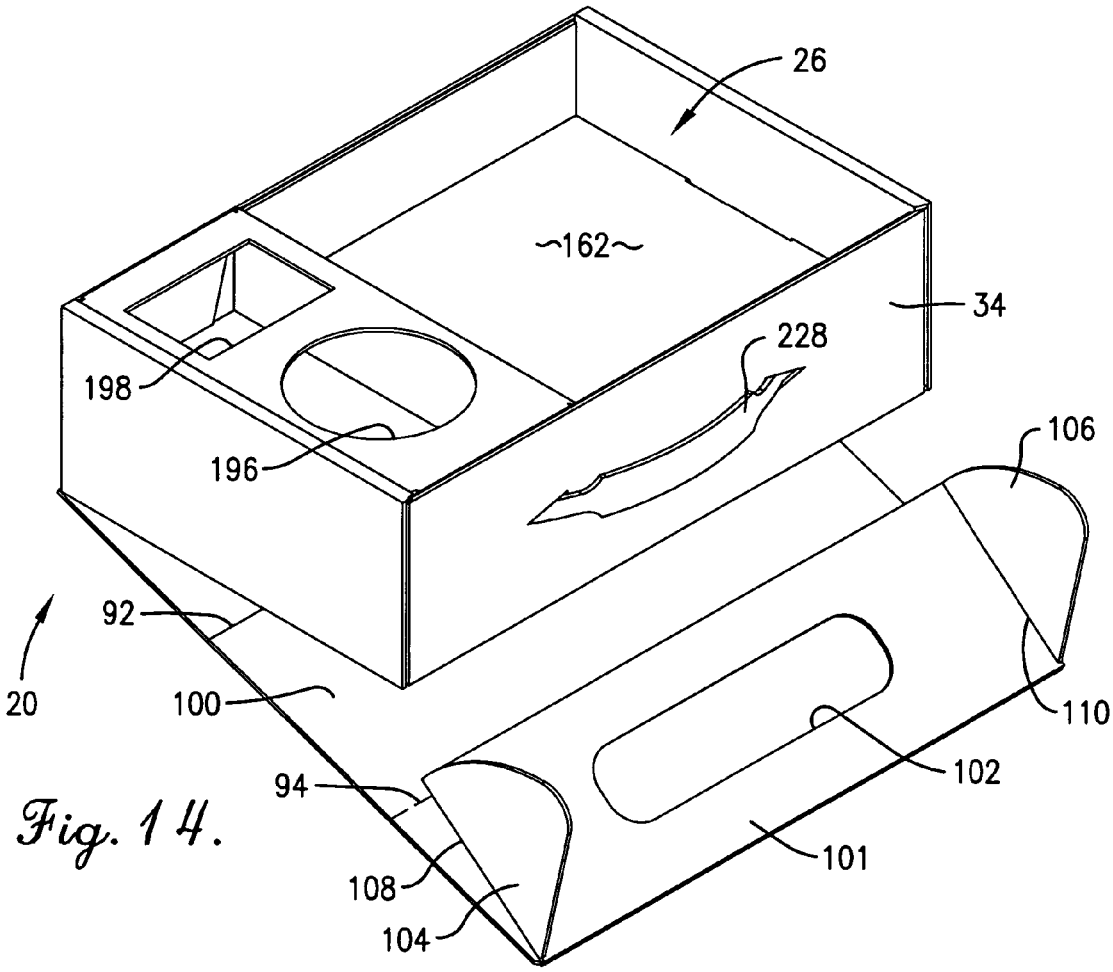
FIG. 14 is a perspective view of the completed container, but showing the alternate use of the closure assembly in order to create an open-top container.

When it is desired to access the contents of container 20, the connection panel 101 is folded upwardly and outwardly until the flaps 104, 106 are free, and the closure assembly 38 is lifted upwardly about fold line 92 until top panel 100 is no longer in covering relationship with the open top of container 22, allowing access to the contents above top panel 114. Closure assembly 38 is then unfolded about fold line 84 to allow access to storage compartment 229, as in FIG. 10. When it is desired to secure closure assembly 38 when in an open configuration, such that closure assembly 38 is stowed out of the way of the user, closure assembly 38 is folded under container 22 about fold line 84, and is placed beneath bottom panel 36. In this manner, rear panel 98 and the portion of top panel 100 between fold line 92 and fold line 94 are positioned in facing and contacting relationship with bottom panel 36. The assembly 38 is then folded upwardly about intermediate fold line 94, while reverse folding the connection panel 101 against the face of the portion of top panel 100 between fold lines 94 and 96 (see FIG. 14). Then, assembly 38 is folded upwardly along fold line 94, such that connection panel 101 is positioned in facing contact with front panel 34, as the flaps 104, 106 are again inserted between the side margins 44 and 46 of front panel 34 and the adjacent segments 68*a* and 70*a* of second flap 68, 70, so that the container 20 assumes the position depicted in FIG. 15. In this orientation, the user can access storage compartment 229 and also the contents placed within tray insert 26 (or on shelf top panel 114 if tray insert 26 is not utilized in a particular configuration) without any interference from closure assembly 38, effectively converting container 20 into a tray or activity surface.

It will be appreciated that the blanks and fabricated container components can be produced from a variety of materials, so long as they are suitable for container and activity usage. In addition, in the illustrated embodiment, the fold lines shown as dashed lines are perforation lines, whereas solid fold lines are score lines. Here again, the use of particular types of fold lines is a matter of design choice.

I claim:

1. A container comprising:

a primary container having a bottom wall panel presenting front, rear and side margins, a pair of opposed sidewall panels extending upwardly from the side margins of said bottom wall panel, and a front wall panel extending upwardly from said front margin of said bottom wall panel, said primary container presenting an open top defined by the upper edges of said sidewall panels and said front wall panel remote from said bottom wall panel;

a shelf within said primary container and having a top panel presenting front, rear and side margins, a pair of upstanding shelf side panels secured to the side margins of said shelf top panel and extending downwardly therefrom, so that said top panel is located generally parallel with and in spaced relationship to said bottom wall panel and below the upper edges of said sidewall panels and said front wall panel, and a shelf back wall panel extending upwardly from said rear margin of said shelf top panel, said shelf including a pair of connection openings, with each connection opening being disposed adjacent one of the side margins of the top panel and receiving therein a connection portion of the primary container to secure said shelf within the primary container, said bottom wall panel and top panel cooperatively defining a storage space therebetween having a rearwardly facing access opening; and a closure assembly operatively secured to the rear margin of said bottom wall panel and configured to cover said access opening and to extend forwardly to cover said open top of said primary container.

2. The container of claim 1, said front wall panel having a pair of rearwardly extending first flaps respectively located adjacent said primary container sidewall panels.

3. The container of claim 2, including a second flap secured to the upper edges of each of said primary container sidewall panels, said second flaps being folded over and covering said first flaps.

4. The container of claim 3, said connection portions comprising elongated tabs extending along the second flaps and protruding generally outwardly therefrom.

5. The container of claim 4, said connection openings comprising elongated slots extending along the side margins of the top panel.

6. The container of claim 4, said elongated tabs each extending generally parallel to the upper edges of each of said primary container sidewall panels.

7. The container of claim 1, including a second flap secured to the upper edges of each of said primary container sidewall panels, said second flaps being folded over and covering portions of said shelf side panels.

8. The container of claim 1, said closure assembly including a rear wall panel configured to extend from said bottom wall panel rear margin and substantially to the upper edges of said sidewall panels, and of said shelf back wall panel, to cover said access opening, a closure panel configured to cover said open top, and a connection panel configured to overlie said front wall panel.

9. The container of claim 8, said connection panel having a pair of third flaps, said third flaps insertable between said front wall panel and said sidewalls.

10. The container of claim 8, said front wall panel having a carrying handle, and said connection panel having an opening configured to receive said carrying handle.

11. The container of claim 8, said closure assembly having a pair of opposed side margins and an outboard margin extending between the closure assembly side margins, with first, second and third mutually parallel and spaced apart fold lines extending between closure assembly side margins, the distance between said first fold line and the adjacent margin of said bottom wall panel being substantially equal to the distance between the bottom wall panel and the upper edge of said front wall panel, the distance between said first and third fold lines being substantially equal to the distance between the front and rear margins of said bottom wall panel, the distance between said second fold line and the adjacent margin of said bottom wall panel being substantially equal to the distance between the front and rear margins of said bottom wall panel.

12. The container of claim 1, including a tray seated on said top panel and having a tray bottom wall panel adjacent the top panel, three tray sidewall panels extending upwardly from the tray bottom wall panel, and an apertured tray top wall panel extending laterally from one of said tray sidewall panels.

13. The container of claim 1, said storage space being configured to receive a video cassette.

* * * * *